United States Patent [19]

Bychinsky

[11] 3,948,348

[45] Apr. 6, 1976

[54] WAVE INTERFERENCE SILENCER CONSTRUCTION

[75] Inventor: Wilfred A. Bychinsky, Burton, Mich.

[73] Assignee: General Motors Corporation, Detroit, Mich.

[22] Filed: May 12, 1975

[21] Appl. No.: 576,723

[52] U.S. Cl. ..... 181/44; 181/53

[51] Int. Cl.[2] ..... F01N 1/06

[58] Field of Search ..... 181/33 L, 35 R, 35 B, 41, 181/44, 46, 53, 54, 56, 69

[56] References Cited

UNITED STATES PATENTS

| | | | |
|---|---|---|---|
| 1,338,520 | 4/1920 | Moores | 181/44 |
| 2,014,666 | 9/1935 | Peik | 181/44 X |
| 2,031,451 | 2/1936 | Austin | 181/44 |
| 3,113,635 | 12/1963 | Allen et al. | 181/44 X |
| 3,263,772 | 8/1966 | Irwin et al. | 181/35 BX |
| 3,353,628 | 11/1967 | Gilbert | 181/53 |

*Primary Examiner*—Lawrence R. Franklin
*Attorney, Agent, or Firm*—J. C. Evans

[57] ABSTRACT

A low cost wave interference silencer including an enclosure having an inlet and an outlet with a direct bypass communication therebetween with a first acoustical length and further including a plurality of flat fin components enclosed between wall segments of the enclosure to define a plurality of series-connected flow paths arranged in spaced parallelism and including segments in reverse flow relationship to define a second flow path between the inlet and the outlet having an acoustical length greater than that of first acoustical length to produce a phase shift of a sound frequency within the exhaust flow between the inlet and the outlet and a resultant wave interference attenuation thereof.

3 Claims, 5 Drawing Figures

WAVE INTERFERENCE SILENCER CONSTRUCTION

This invention relates to wave interference mufflers and more particularly to wave interference mufflers having a direct acoustical and exhaust pipe and a fabricated baffle component supported between first and second wall portions of the muffler to define an exhaust flow passageway as well as a second sound path having an acoustical length to produce a phase shift in sound frequency between the inlet and outlet of the muffler for wave interference attenuation.

Various proposals have been suggested for utilizing phase shaft principle to attenuate sound frequencies in muffler devices. One such arrangement is set forth in U.S. Pat. No. 3,580,357 issued May 25, 1971, to Whitney. This arrangement includes a helical baffle component interposed between first and second concentric tubes having equal lengths. Such helical baffles have a high vane height to pitch ratio in certain applications. It is difficult to fabricate such baffles when the helical vane height becomes much larger than the pitch.

Accordingly, the object of the present invention is to improve wave interference muffler assemblies by the provision of baffle components therein that are formed as flat planar fins and arranged to define an exhaust flow and acoustical path between the inlet and the outlet of a wave interference silencer that is separate from a second path for sound and gas flow that is a direct bypass connection between the inlet and outlet of the muffler.

Yet another object of the present invention is to provide an improved wave interference silencer including inner and outer concentrically arranged tube components and wherein a plurality of radially outwardly directed fins are located in a space between the inner and outer tubes at circumferentially spaced points around the outer circumference of the inner tube, each fin having a width equal to the spacing between the tubes and each fin having opposite ends thereon in engagement with end closures or spaced with respect thereto to define a plurality of series-connected passages with reverse flow therethrough of an acoustical length greater than that of the inner tube for producing wave interference attenuation of sound in the exhaust flow from the inlet to the outlet of the assembly.

Yet another object of the present invention is to provide a wave interference construction that includes a boxlike enclosure made up of flat plate components and having a plurality of planar fins supported therein to define a plurality of series-connected parallel passages between the inlet and the outlet of the muffler including a reverse flow path therein and wherein one of the fins cooperates with the box enclosure to define a direct bypass connection between the inlet and outlet having an acoustical length less than that of the acoustical length of the exhaust flow path through the series-connected passages thereby to produce a wave interference attenuation of sound frequencies in the exhaust flow passing from the inlet to the outlet of the device.

Further objects and advantages of the present invention will be apparant from the following description, reference being had to the accompanying drawings wherein a preferred embodiment of the present invention is clearly shown.

Figure 1:
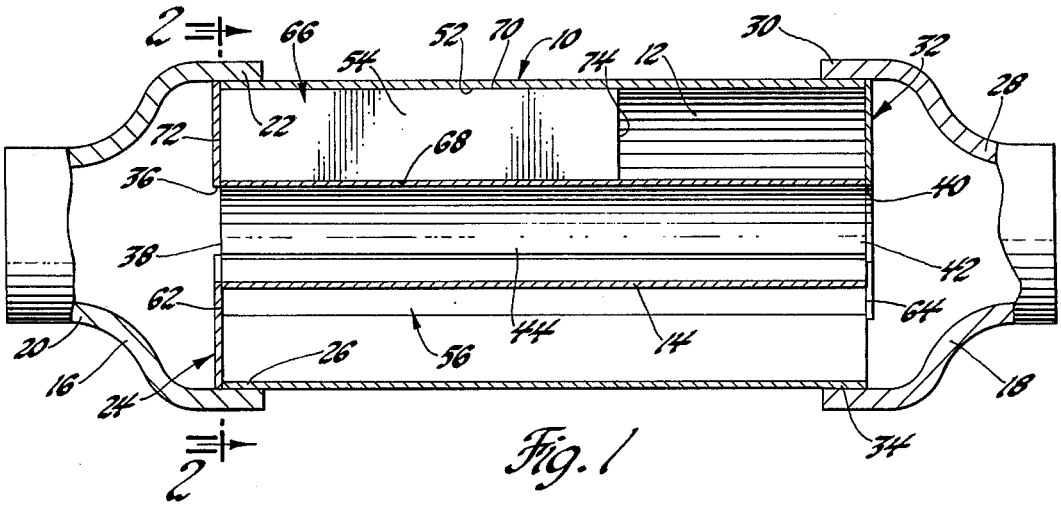
FIG. 1 is a view in a longitudinal section of a wave interference muffler constructed in accordance with the present invention.

In FIG. 1 a wave interference muffler assembly 10 is illustrated. It includes an outer tubular member 12 and an inner tubular member 14 arranged concentrically of the outer tube 12. Each of the tubes 12, 14 has an equivalent length between an inlet adapter 16 and an outlet adapter 18. The inlet adapter 16 includes a small diameter end 20 adapted to be connected to the exhaust pipe of an internal combustion engine. It further includes a large diameter end 22 that receives an inlet closure plate 24 and an annular end segment 26 of the outer tube 12. The adapter 18 includes a small diameter end 28 adapted to be connected to the tail pipe of a vehicle and a larger diameter portion 30 thereon that supportingly receives an outlet closure plate 32 and an annular end segment 34 of the tube 12.

The inlet closure plate 24 includes a central, circular hole 36 therein in alignment with the inlet end 38 of the inner tube 14. The outlet closure plate 32 includes a central, circular opening 40 that is in alignment with the outlet end 42 of the inner tube 14. The inner tube 14 thus is in direct communication with the inlet adapter 16 and the outlet adapter 18 to define a straight line bypass passage 44 therebetween.

Figure 2:
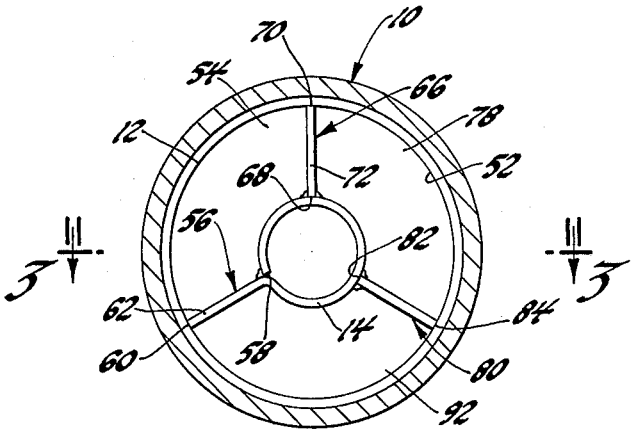
FIG. 2 is a vertical sectional view taken along the line 2—2 of FIG. 1 looking in the direction of the arrows.
Figure 3:
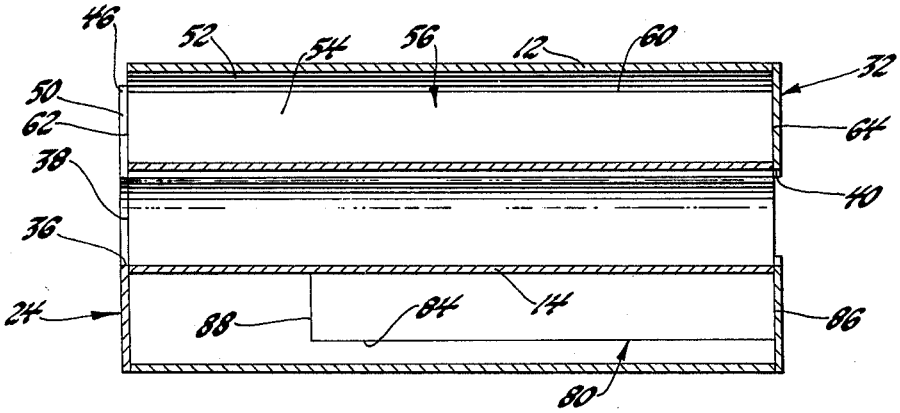
FIG. 3 is a horizontal sectional view taken along the line 3—3 of FIG. 2 looking in the direction of the arrows.
Figure 4:
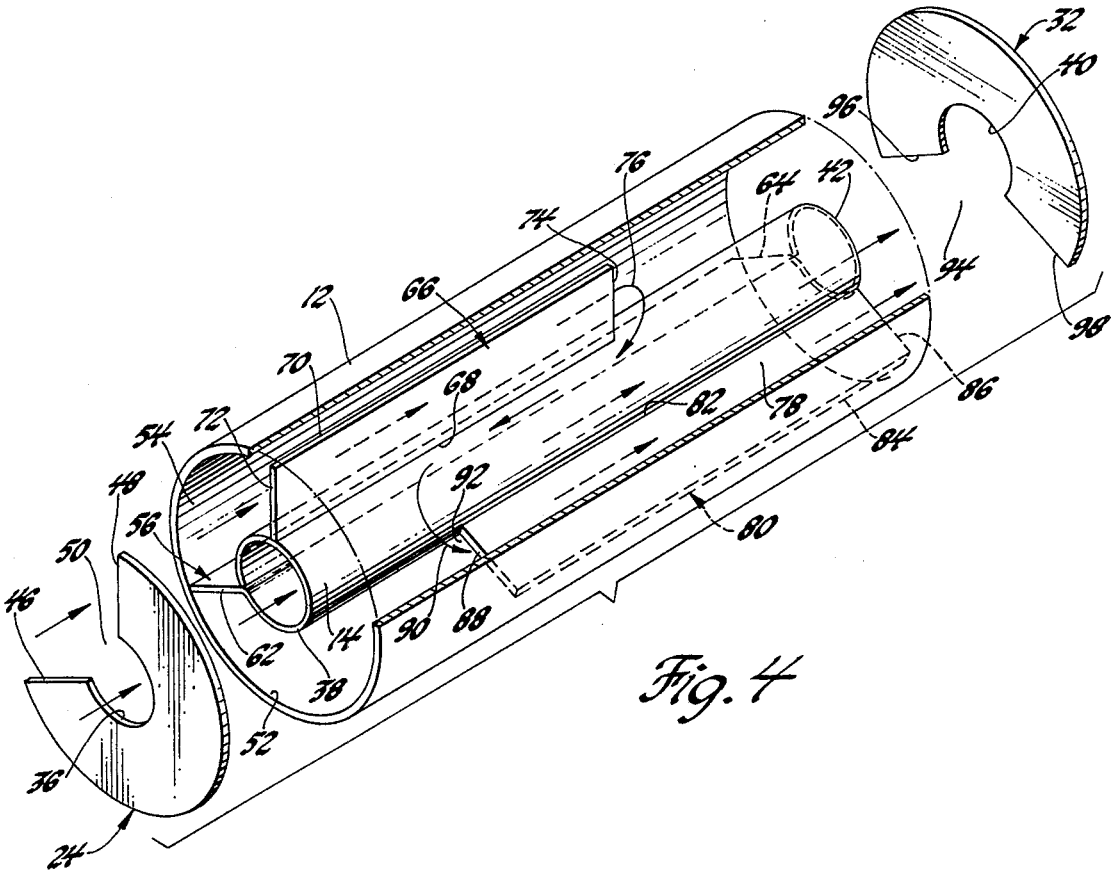
FIG. 4 is an exploded perspective view showing the acoustical paths in the device of FIGS. 1 through 3.

As best seen in FIG. 4, the inlet closure plate 24 includes arcuately spaced edges 46, 48 thereon that define an opening 50 into the annular space 52 between the inner and outer tubes 12, 14. The opening 50 is to a first passage 54 that is defined in part by a first flat planar fin element 56 having a width equal to the space between the inner tube 14 and the outer tube 12 and extending radially therebetween. As best seen in FIG. 2, the fin 56 includes an inner edge 58 that is spot welded to the outer circumference of the inner tube 14 along the length thereof. It further includes an outer edge 60 thereon that is in engagement with the inner circumference of the outer tube 12. The fin 56 extends longitudinally throughout the length of the inner tube 14 and includes opposite ends 62, 64 thereon each in engagement with the oppositely located closure plates 24, 32 thereby to define one wall of the passage 54.

A second wall of the passage is defined by a second flat, planar fin 66 that is located at a position circumferentially spaced from the fin 56 to extend radially from the outer circumference of the tube 14 to the inner circumference of the tube 12 as seen in FIG. 2. The fin 66 has a width equal to the spacing between the tubes 12, 14 and is spot welded at an inner edge 68 thereof along the length of the tube 14 and has the outer edge 70 thereon in engagement with the inner circumference of the tube 12. The fin 66 includes a first end 72 in engagement with the inlet closure plate 24 and it further includes a second end 74 thereon located in spaced relationship to the inner surface of the outlet closure plate 32 as best seen in FIG. 4. The space between the end 74 and the plate 32 constitutes a crossover path represented by the arrow 76 in FIG. 4 into a second series-connected, parallel flow passage 78 located in the space 52 between the tubes 12, 14. The passage 78 is formed by the previously described fin 66 and a third fin 80. The third fin 80 also has a flat planar configuration. It is located at a circumferentially spaced position from the fins 56, 66 radially therebetween. In the illustrated arrangement, all of the fins are spaced equidistantly from one another. The fin 80 includes an inner edge 82 thereon spot welded to the outer circumference of the tube 14 along its length. It further includes an outer edge 84 in engagement with the inner circumference of the tube 12. The fin 80, as best seen in FIG. 4, includes a first end 86 in sealed engagement with the outlet closure 32. It has an opposite end 88 thereon in spaced relationship to the inlet closure 24 to define a crossover passage represented by the arrow 90 in FIG. 4 into an outlet passage 92 defined between the fins 56 and 80. The outlet passage 92 is in communication with an opening 94 formed in an arcuate segment of the closure plate 32 between edges 96, 98 thereon.

At the inlet end, the closure 24 blocks passages 78, 92 and at the outlet, passages 54, 78 are blocked by the outlet closure 32. Accordingly, exhaust gas entering the inlet adapter 16 will be divided by the inlet closure 24 to flow through both the passage 44 constituting a direct bypass communication between the inlet and outlet adapter 16, 18 and to pass through the series-connected passages 54, 78 and 92 all constituting spaced parallel series-connected passages that will produce a reversal of flow in an outer flow path between the inner and outer tubes 14, 12 respectively. The series-connected passages 54, 78, 92 have an equivalent acoustical length to produce a phase shift of certain sound frequencies therein as compared to sound passage through the shorter inner passage 44. The out-of-phase shift produced by virtue of the greater length of the outer passage between the tubes 14, 12 will produce a first predetermined wave interference attenuation of sound frequencies in the exhaust flow between the inlet adapter 16 and outlet adapter 18. Additionally, sound will be reflected from the inlet and outlet closures 24, 32 through the passages 54, 78 and 92 to produce a further attenuation of noise in the muffler assembly 10.

The length of the fins 56, 66, 80 can be varied to produce different effective path lengths within the space 52 formed between the inner and outer tubes 14, 12.

The aforesaid structure is easily assembled since the inner tube 14 and the continuous length fin 56 can be integrally formed from a single piece of material as shown in FIG. 2. The other fins are easily assembled by spot welding their inner edge to the inner tube. The outer tube 12 preferably is in the form of a welded tube that constitutes an outer jacket fitted over the assembly and drawn down to assure a press-fit relationship between the outer edges 60, 70, 84 and the inner circumference of the outer tube.

Figure 5:
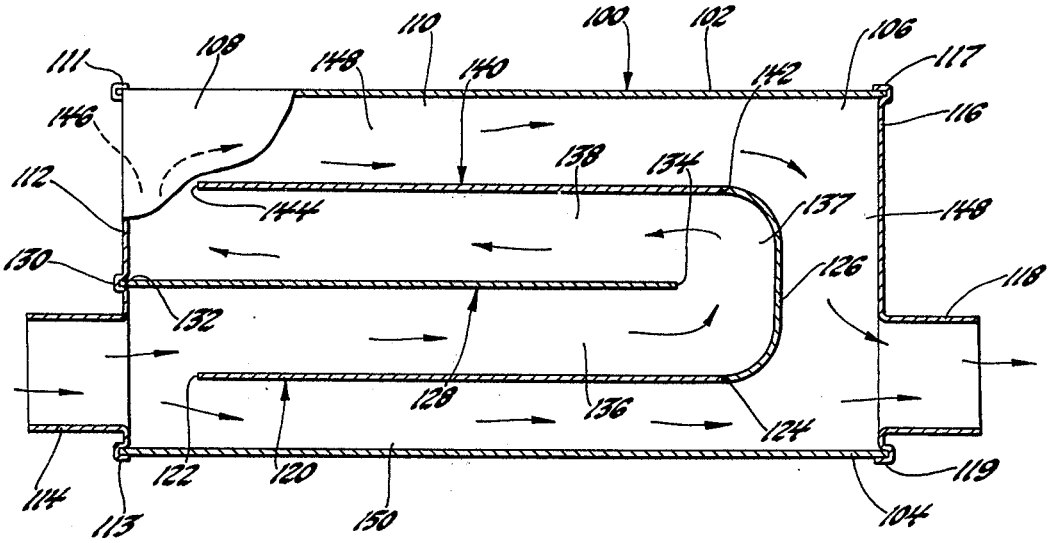
FIG. 5 is a cross sectional view of another embodiment of an interference silencer constructed in accordance with the present invention.

An alternative construction of the present invention is illustrated in FIG. 5. It is in the form of a rectangularly configured box-like enclosure 100 made up of flat side walls 102, 104 and a flat base 106. Each of the walls 102, 104 and base 106 are joined at an intersection by suitable means such as welding or can be formed from a single bent sheet. A cover shown partially at the corner of the enclosure 100 in FIG. 5 is designated by reference numeral 108 and is suitably secured to the side walls 102, 104 to define the perimeter of an interior volume 110 of the muffler assembly 100. An inlet closure 112 has bent edges 111, 113 joined to walls 102, 104. It also has an inlet tube 114 formed therein adapted to be connected to the exhaust pipe of an internal combustion engine. An outlet closure plate 116 has bent edges 117, 119 joined to the walls 102, 104 and also has an outlet pipe 118 formed therein adapted to be connected to a tailpipe assembly.

In the illustrated arrangement the muffler 100 includes a first flat planar fin 120 having a height equal to the spacing between the base 106 and the cover 108 of the muffler 100. The fin 120 includes a leading edge 122 located in alignment with the inlet tube 114. The fin 120 has an opposite end 124 thereon connected to a curved baffle 126. A second flat planar fin 128 has a first end 130 thereon fit in a transverse groove 132 formed in the inlet closure 112. It has an opposite end 134 thereon located in spaced relationship to the curved baffle 126. The fin 128 has a depth equal to the spacing between the base 106 and the cover 108 and forms a first passage 136 that receives part of the flow from the inlet 114 as divided by the inlet edge 122 of the fin 120. The flow from the passage 136 is directed by the curved baffle 126 through crossover passage 137 into a second parallel series-connected passage 138 formed by the fin 128 and a third fin 140 having one end thereon 142 connected to curved baffle 126 and an opposite end 144 thereon located in spaced relationship to the inlet closure 112. The fin 140 has a depth equal to the spacing between base 106 and cover 108 and is located in sealed relationship thereto to define a counterflow path with respect to that through the passage 136 and a path which terminates in communication with a crossover passage 146 into an outlet passage 148 formed between the fin 140 and the side wall 102. The outlet passageway 148 is further defined by a space between the outer wall of the curved baffle 126 and the outlet closure 116 to the outlet 118.

Additionally, the muffler assembly 100 includes a direct bypass connection between the inlet 114 and outlet 118 defined by space 150 between the fin 120 and the side wall 104. The space 150 receives part of the inlet flow as divided by the fin 120 and will direct it through a relatively short distance to the outlet 118.

The series-connected, parallel passages 136, 138, 148 are continually swept by the exhaust flow that is directed therethrough by the fin 120. Furthermore, the acoustical length of the aforesaid series-connected paths is substantially greater than the path through space 150 and is selected to produce a phase shift of sound frequencies in the exhaust flow from the inlet 114 to the outlet 118. This phase shift of sound frequencies will produce wave interference attenuation of sound frequencies at the outlet 118. Additional attenuation is produced by the reflection of sound waves from the closures 112, 116 through the passages 138, 148.

As in the case of the first embodiment, the flat planar components in the embodiments of FIG. 5 are easily assembled without the requirement for special tools. The assembly will produce a broad range of noise attenuation without producing any substantial increase in pressure drop of exhaust flow divided between the bypass connection 150 and the aforesaid described series-connected, parallel passages.

While the embodiments of the present invention, as herein disclosed, constitute a preferred form, it is to be understood that other forms might be adopted.

What is claimed is:

1. A wave interference silencer comprising an enclosure having an inlet and an outlet, means within said enclosure including first and second fins supported therein to define a first exhaust passage in communication with the inlet, means including a third fin and said second fin supported within said enclosure to define a second exhaust passage in spaced parallelism to said first exhaust passage and in communication with said outlet, said second exhaust passage being series-connected in reverse flow relationship to said first passage, means defining a direct flow interconnection between said inlet and outlet, said last mentioned means including means for diverting exhaust flow from the inlet into both said direct flow interconnection and said first and second series parallel passages, said first and second series flow connected and spaced parallel passages having an acoustical length greater than that of said direct flow interconnection for producing a frequency shift in noise frequencies to produce wave interference attenuation of sound waves propagated in the exhaust flow between the inlet and the outlet of said enclosure.

2. A wave interference silencer comprising an outer tube and a concentrically arranged inner tube, said outer and inner tubes having equal lengths, inlet and outlet closure means on opposite ends of said inner and outer tubes, a first longitudinally directed flat planar fin having a length equal to that of said first and second tubes and a width equal to the spacing between said inner and outer tubes supported therein for defining one side of a first flow passage, a second fin located arcuately of said first fin and having a length less than that of the length of said inner tube, said second fin having a width equal to the spacing between said concentrically arranged tubes to define a second side of said first flow passage, said second fin having an end portion thereon spaced from the outlet closure means, a third fin having a width equal to the spacing of said first and second tubes located arcuately of said second fin and having one end thereof in engagement with said outlet enclosure and in spaced relationship to said inlet closure, said third fin extending longitudinally to define a wall segment of a second flow passage in spaced parallelism and in reverse flow relationship to said first flow passage, said first and third fins further defining an outlet passage, said third fin being spaced from the inlet closure means to define a cross connection between said second passage and said outlet passage, said inlet closure means including means to divide flow for passage through said inner tube and said first and second passages, said first and second passages and said outlet passage having an acoustical length greater than that of the acoustical path length through said inner tube to produce an out-of-phase relationship of sound frequencies in the exhaust flow for wave interference attenuation of noise frequency in the exhaust flow from said tubes.

3. A wave interference silencer comprising a rectangularly configured flat enclosure having opposite end walls thereon, an inlet connected to one of said end walls and an outlet connected to the other of said end walls, a flat planar fin supported within said rectangularly configured box and extending longitudinally of said box to define a wall portion of a first passage, a second fin of flat planar configuration extending longitudinally of the box and defining a second wall portion of the first passage, a third flat planar fin located in spaced parallelism with said first and second fins extending longitudinally of said enclosure to define a wall portion of a second passage having the first fin as a second wall portion thereof, means for connecting said first and second passages in series flow relationship, flow through said second passage being in counterflow relationship to flow through the first passage, means for defining a bypass connection between said inlet and said outlet in parallel flow relationship to said first and second passages, outlet passage means for communicating flow from said second passage with the outlet said second fin dividing flow from the inlet between said first and second passages and said bypass connection for causing substantial quantities of exhaust flow to sweep both said first and second passages and said bypass connection, said first and second passages and said outlet passage means having an acoustical length greater than that of said bypass connection to produce an out-of-phase relationship of sound frequencies in the exhaust flow passage therethrough, said out-of-phase relationship of the sound frequencies in the gas flow producing a predetermined wave interference attenuation of sound frequencies in the exhaust flow between said inlet and said outlet.

* * * * *